US012258864B2

(12) United States Patent
Suwano et al.

(10) Patent No.: US 12,258,864 B2
(45) Date of Patent: Mar. 25, 2025

(54) TUNNEL EXCAVATION DEVICE

(71) Applicant: KOMATSU LTD., Tokyo (JP)

(72) Inventors: Masahiro Suwano, Tokyo (JP); Naoki Sekiyama, Tokyo (JP); Hiroshi Asano, Tokyo (JP); Taku Arakawa, Tokyo (JP)

(73) Assignee: KOMATSU LTD., Tokyo (JP)

( * ) Notice: Subject to any disclaimer, the term of this patent is extended or adjusted under 35 U.S.C. 154(b) by 215 days.

(21) Appl. No.: 17/923,635

(22) PCT Filed: Apr. 22, 2021

(86) PCT No.: PCT/JP2021/016324

§ 371 (c)(1),
(2) Date: Nov. 7, 2022

(87) PCT Pub. No.: WO2021/230034

PCT Pub. Date: Nov. 18, 2021

(65) Prior Publication Data

US 2023/0203949 A1 Jun. 29, 2023

(30) Foreign Application Priority Data

May 12, 2020 (JP) ..... 2020-083822

(51) Int. Cl.
*E21D 9/10* (2006.01)
*E21D 9/11* (2006.01)
*E21D 11/40* (2006.01)

(52) U.S. Cl.
CPC ..... *E21D 9/112* (2013.01); *E21D 9/1093* (2013.01); *E21D 11/40* (2013.01)

(58) Field of Classification Search
CPC ..... E21D 9/112; E21D 9/1093; E21D 11/40
See application file for complete search history.

(56) References Cited

U.S. PATENT DOCUMENTS 3,598,445 A 8/1971 Winberg
3,957,310 A * 5/1976 Winberg ..... E21D 9/112 299/56

(Continued)

FOREIGN PATENT DOCUMENTS

CN 101598018 A 12/2009
CN 102410027 A 4/2012

(Continued)

OTHER PUBLICATIONS

The International Search Report for the corresponding international application No. PCT/JP2021/016324, issued on Jul. 13, 2021.

(Continued)

*Primary Examiner* — Carib A Oquendo
(74) *Attorney, Agent, or Firm* — Global IP Counselors, LLP

(57) ABSTRACT

A tunnel excavation device includes a main body a frame and a workbench. The main body includes a front body section and a rear body section. The front body section includes a cutter head provided with a plurality of disk cutters. The rear body section is disposed behind the front body section and includes a gripper section for obtaining a reaction force when excavating. The frame is disposed continuously behind the main body. The workbench is disposed above the frame so as to be rotatable with respect to the frame.

17 Claims, 8 Drawing Sheets

(56) References Cited

U.S. PATENT DOCUMENTS

| | | | | |
|---|---|---|---|---|
| 4,365,676 | A * | 12/1982 | Boyadjieff | E21B 4/18 175/62 |
| 4,548,443 | A * | 10/1985 | Turner | E21D 9/1093 299/31 |
| 5,205,612 | A * | 4/1993 | Sugden | E21D 9/1093 299/10 |
| 5,931,601 | A * | 8/1999 | Terada | E21B 7/28 405/138 |
| 2014/0084667 | A1 | 3/2014 | Rower et al. | |
| 2015/0152728 | A1* | 6/2015 | Hartwig | E21D 9/1093 299/10 |
| 2016/0230553 | A1* | 8/2016 | Kuramoto | E21D 9/108 |
| 2018/0171799 | A1* | 6/2018 | Moberg | E21D 9/1093 |

FOREIGN PATENT DOCUMENTS

| | | | |
|---|---|---|---|
| CN | 103899335 | A | 7/2014 |
| CN | 106194211 | A | 12/2016 |
| CN | 106761819 | A | 5/2017 |
| CN | 209892219 | U | 1/2020 |
| DE | 20 2011 050 144 | U1 | 10/2012 |
| JP | 8-189291 | A | 7/1996 |
| JP | 10-220191 | A | 8/1998 |
| JP | 2000-274197 | A | 10/2000 |
| JP | 2007-146654 | A | 6/2007 |
| JP | 2010-222960 | A | 10/2010 |
| JP | 2015-155603 | A | 8/2015 |
| KR | 10-1007634 | B1 | 1/2011 |

OTHER PUBLICATIONS

The Examination report No. 1 for the corresponding Australian application No. 2021271467, dated Oct. 12, 2023.

The Office Action for the corresponding Chinese application No. 202180021455.X issued on Sep. 14, 2024.

Meng Fang et al., Analysis of the Hydraulic System of Material Cranes for Full-face Tunnel Boring Machines (TBM), Hyd.Pneum. &Seals, No. 4 (Serial No. 94), Aug. 2002.

* cited by examiner

TUNNEL EXCAVATION DEVICE

CROSS-REFERENCE TO RELATED APPLICATIONS

This application is a U.S. National stage application of International Application No. PCT/JP2021/016324, filed on Apr. 22, 2021. This U.S. National stage application claims priority under 35 U.S.C. § 119(a) to Japanese Patent Application No. 2020-083822, filed in Japan on May 12, 2020, the entire contents of which are hereby incorporated herein by reference.

TECHNICAL FIELD

The present disclosure relates to a tunnel excavation device used when excavating a tunnel.

BACKGROUND ART

The tunnel excavation device body includes a cylindrical front body section and a rear body section. The front body section includes a rotatable cutter head on the front side. A plurality of disk cutters are mounted on the front face of the cutter head. The rear body section includes a gripper shoe that presses against the pit wall to obtain a reaction force for excavation. The front body section and the rear body section are connected by a plurality of hydraulic cylinders. Selective extension of the cylinder allows the front body section to bend with respect to the rear body section.

The rear body section is fixed to the tunnel with the gripper shoe, the hydraulic cylinders are extended, and the cutter head is pressed against the working face (surface to be excavated) to be rotated. This allows the disk cutter to crush the rock in the working face and to perform the excavation.

The front body section further comprises an erector. An erector is a device for building up the support into the pit wall. The support is an arch-shaped or ring-shaped steel material for supporting the inner wall of a tunnel. A frame including a workbench is arranged behind the rear body section so as to be connected to the rear body section.

A workbench is provided behind the rear body section. The workbench is a scaffolding used by workers to perform part of the lining work after the support has been installed. For example, the workbench shown in Japanese Laid open Patent 2000-274197 is provided on a frame so as to be movable in a front-rear direction, the radial direction, and the circumferential direction of the tunnel. The supports are installed along the radial direction of the tunnel with high precision for strength reasons, and the lining work is performed between the supports.

SUMMARY

However, in the state where the curve radius of the tunnel curved portion is small, when the movable directions of the workbench as described in Japanese Laid open Patent 2000-274197 are only the front-rear direction, the radial direction, and the circumferential direction of the tunnel, the misalignment between the direction of the support and the direction of the workbench may be large and it may be difficult to perform the lining work.

An object of the present disclosure is to provide a tunnel excavation device that facilitates lining work when constructing a sharply curved tunnel.

A tunnel excavation device according to the present disclosure includes a main body, a frame, and a workbench.

The main body includes a front body section and a rear body section. The front body section includes a cutter head on which a plurality of cutters are provided. The rear body section includes a gripper section for obtaining a reaction force when excavating, and is disposed behind the front body section. The frame is disposed behind the main body and connected to the main body. The workbench is disposed above the frame so as to be rotatable with respect to the frame.

According to the present disclosure, it is possible to provide a tunnel excavation device that facilitates lining work when constructing a sharply curved tunnel.

DESCRIPTION OF EMBODIMENTS

A tunnel excavation device of an embodiment according to the present disclosure will be explained with reference to the drawings.

The tunnel excavation device of the present embodiment is a so-called open type TBM among TBMs (tunnel boring machines). The tunnel excavation device of the present embodiment can be used for tunnel construction by excavating hard rock.

(Overall Configuration of Tunnel Excavation Device)

Figure 1:
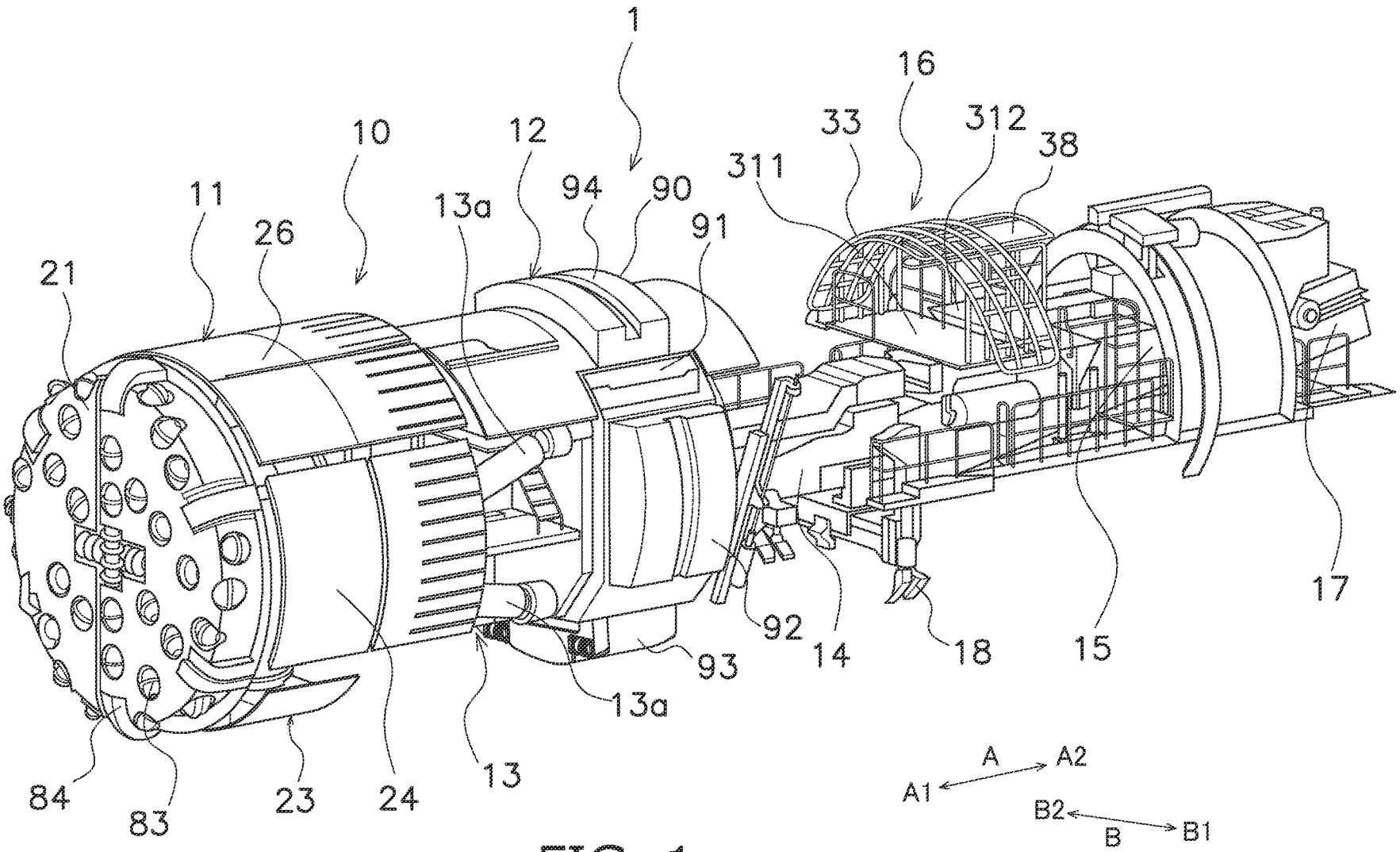
FIG. 1 is a perspective view illustrating a configuration of a tunnel excavation device according to an embodiment of the present disclosure.
Figure 2:
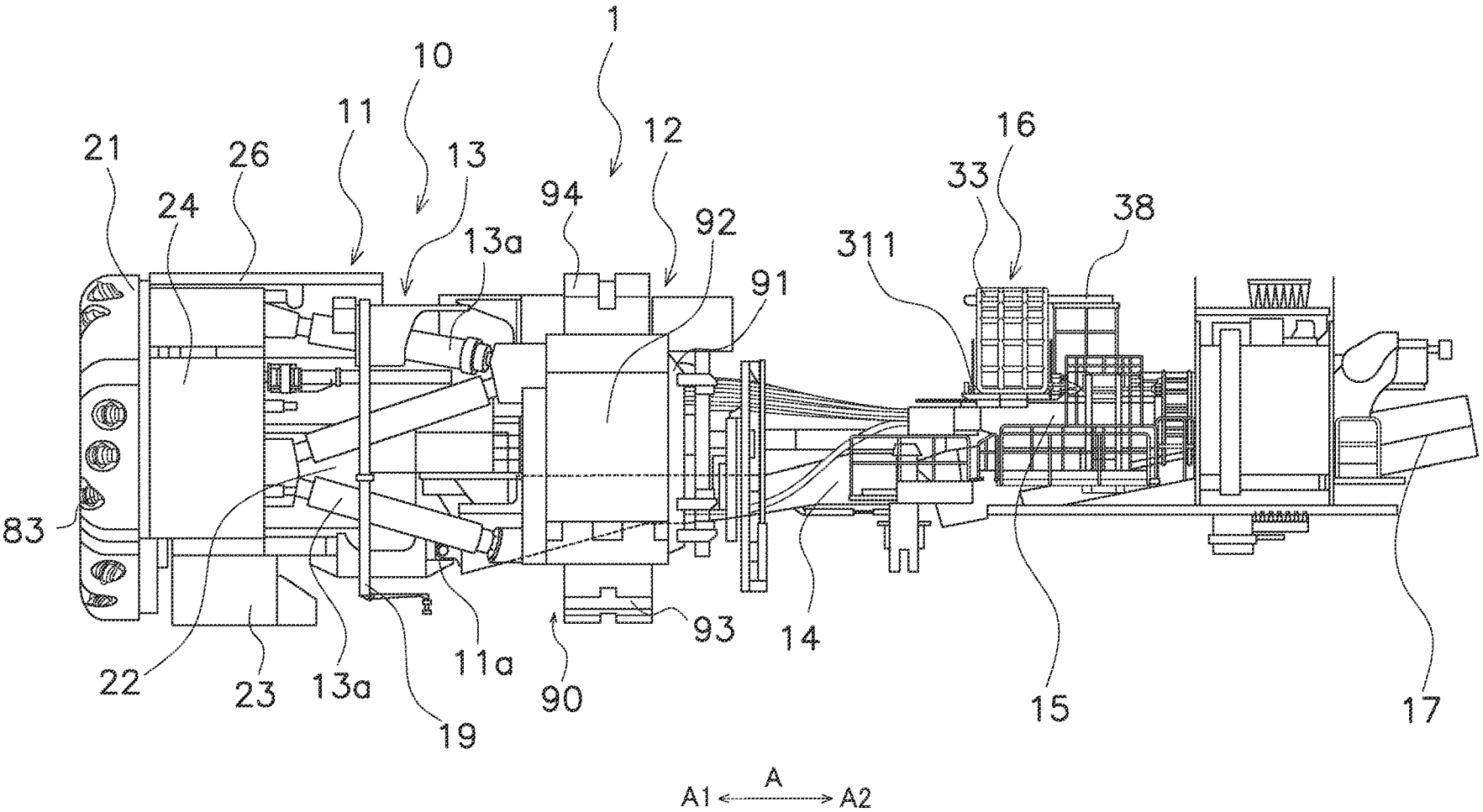
FIG. 2 is a side view of the tunnel excavation device in FIG. 1.

FIG. 1 is a perspective view illustrating a tunnel excavation device 1 of the present embodiment. FIG. 2 is a side view of the tunnel excavation device 1 of the present embodiment.

The tunnel excavation device 1 of the present embodiment causes a cutter head 21 to rotate to perform excavating while being supported on an inner wall of a tunnel with a gripper section 90.

The tunnel excavation device 1 of the present embodiment includes a main body 10, a frame 15, a workbench 16, a belt conveyor 17 and a rear support 18.

The main body 10 includes a front body section 11, a rear body section 12, a connecting section 13, a main beam 14, and an erector 19 (see FIG. 2). As shown in FIG. 1, the front body section 11 includes a cutter head 21 at its front end for excavating rock. The rear body section 12 is disposed on the rear side of the front body section 11 and can be supported on the inner wall of the tunnel by the gripper section 90. In the figure, a front-rear direction is indicated by A, a front direction is indicated by arrow A1, and a rear direction is indicated by arrow A2. The arrow A indicates the front-rear direction when the front body section 11 is disposed linearly with respect to the rear body section 12 without being bent.

An arrow B shown in the figure indicates a width direction, which is a direction perpendicular to the front-rear direction A and is a horizontal direction. In the width direction B, a left side when facing the front direction A1 is indicated by B1, and a right side when facing the front direction A1 is indicated by B2.

The connecting section 13 connects the front body section 11 and the rear body section 12 in a bendable manner. The connecting section 13 includes a plurality of thrust cylinders 13*a*, and one end of each thrust cylinder 13*a* is turnably connected to the front body section 11 and the other end of each thrust cylinder 13*a* is turnably connected to the rear body section 12.

As shown in FIG. 2, the main beam 14 is connected to the front body section 11 by a turnable coupling member 11*a* and supports the rear body section 12 in a manner that allows sliding forward and rearward in the A direction. The main beam 14 extends rearward through the rear body section 12. The frame 15 is turnably attached to the rear end of the main beam 14. The workbench 16 is provided for performing work of attaching to the wire mesh to the inner wall of the tunnel after excavation, and is disposed above the frame 15. The outline of the main beam 14 inside the rear body section 12 is indicated by dotted lines.

The belt conveyor 17 is provided from the front body section 11 through the rear body section 12 to the lower side of the frame 15 and conveys rock and sand excavated by the cutter head 21 to the rear.

A rear support 18 (see FIG. 1) is provided on the main beam 14 and supports the main beam 14 when the rear body section 12 is traveling forward. An erector 19 is disposed at the rear portion of the front body section 11, as shown in FIG. 2, to assemble the support.

Although not indicated in the drawings, a vehicle provided with a control device, a power supply device, and a hydraulic system and the like for driving the cutter head 21, the belt conveyor 17, the plurality of thrust cylinders 13*a*, and the gripper section 70 and the like is joined to the rear of the frame 15.

(Front Body Section 11)

As shown in FIG. 1, the front body section 11 includes a cutter head 21, a cutter head support 22 (see FIG. 2), a vertical support 23, a pair of side supports 24 (only the left side is shown in FIG. 1) and a roof support 26. As shown in FIG. 2, the rear part of the side support 24 on the left side, the rear part of the roof support 26 on the left side, and the left side of the vertical support are omitted in order to show the cutter head support 22, the erector 19, and the like.

The cutter head 21 is provided to the front end of the front body section 11 and is provided so as to be able to rotate with respect to the cutter head support 22. As illustrated in FIG. 1, the cutter head 21 includes a plurality of disk cutters 83 provided to the excavation-side surface. Rock excavated by the disk cutter 83 is taken inside the cutter head 21 by the bucket 84.

The cutter head support 22 is disposed to the rear of the cutter head 21, as shown in FIG. 2. The cutter head support 22 rotatably supports the cutter head 21.

A vertical support 23, a pair of side supports 24 and a roof support 26 are attached to the cutter head support 22 and disposed to surround the cutter head support 22. The vertical support 23, the pair of side supports 24 and the roof support 26 are provided for supporting the cutter head support 22 against the tunnel wall for stabilization during excavation and for protecting the cutter head support 22 from rock slides from the side wall.

The vertical support 23 is disposed below the cutter head support 22. The pair of side supports 24 are disposed on either side in the width direction of the cutter head support 22. The roof support 26 is disposed above the cutter head support 22.

The vertical support 23, the pair of side supports 24, and the roof support 26 are configured to be movable toward or away from the cutter head support 22. That is, the vertical support 23 and the roof support 26 are vertically movable with respect to the cutter head support 22. The pair of side supports 24 are movable outwardly or inwardly in the width direction B with respect to the cutter head support 22.

(Rear Body Section 12)

The rear body section 12 includes a gripper section 90 and a gripper carrier 91 as illustrated in FIG. 1. The gripper section 90 protrudes to the outside from the gripper carrier 91 and presses the tunnel inner wall when excavating and supports the rear body section 12 against the tunnel inner wall.

The gripper section 90 includes a pair of side grippers 92 (only the left side is shown), a lower gripper 93, and an upper gripper 94.

Side grippers 92 are provided on the left and right parts of the gripper carrier 91. The side grippers 92 are moved outward and inward in the width direction B by hydraulic cylinders provided within the gripper carrier 91.

A lower gripper 93 is provided in the lower part of the gripper carrier 91. The lower gripper 93 moves upward and downward by extension and contraction of a hydraulic cylinder provided within the gripper carrier 91.

An upper gripper 94 is provided on the upper part of the gripper carrier 91. The upper gripper 94 moves upward and downward by extension and contraction of a hydraulic cylinder provided within the gripper carrier 91.

(Workbench 16)

The workbench 16 is disposed above the frame 15. The workbench 16 is a workbench on which an operator works to attach a wire mesh between the supports assembled on the tunnel wall by the erector 19.

Figure 3:
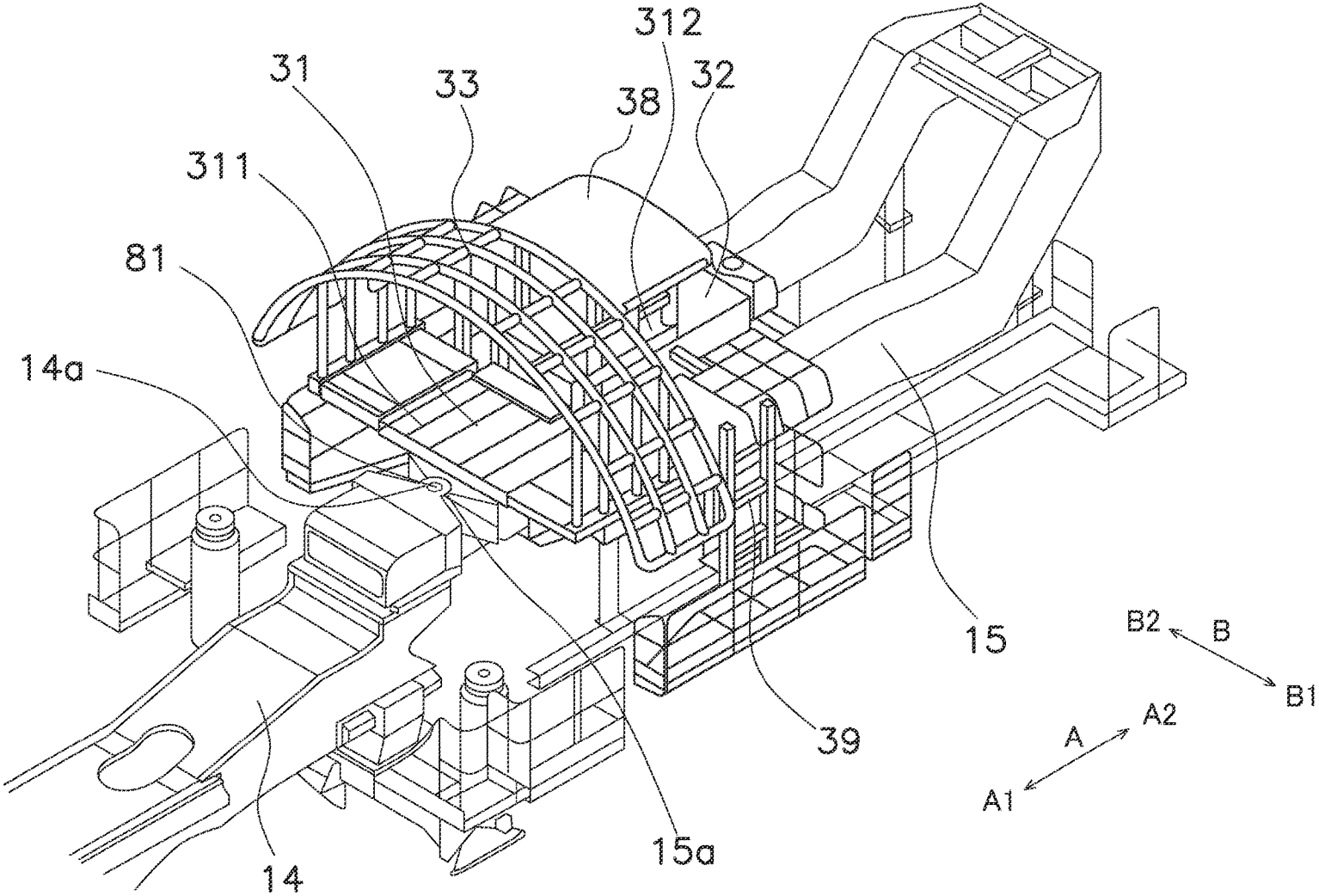
FIG. 3 is a perspective view of the vicinity of a workbench in FIG. 1 as viewed from above.

FIG. 3 is a perspective view of the vicinity of the workbench 16 viewed from above. FIG. 3 shows the main beam 14, the frame 15, and the workbench 16.

As described above, the connecting section 14*a* provided at the rear end of the main beam 14 extending in the front-rear direction is rotatably connected to the connecting section 15*a* provided at the front end of the frame 15. A vertical hole is formed in the connecting section 14*a*, and a vertical hole is formed in the connecting section 15*a*. A connecting member 81 is inserted into both holes of the connecting section 14*a* and the connecting section 15*a*. For example, with such a configuration, the main beam 14 and the frame 15 can rotate relative to each other around the connecting member 81.

The frame 15 is provided along the front-rear direction so as to be continuous with the main beam 14. The workbench 16 is disposed above the frame 15.

Figure 4:
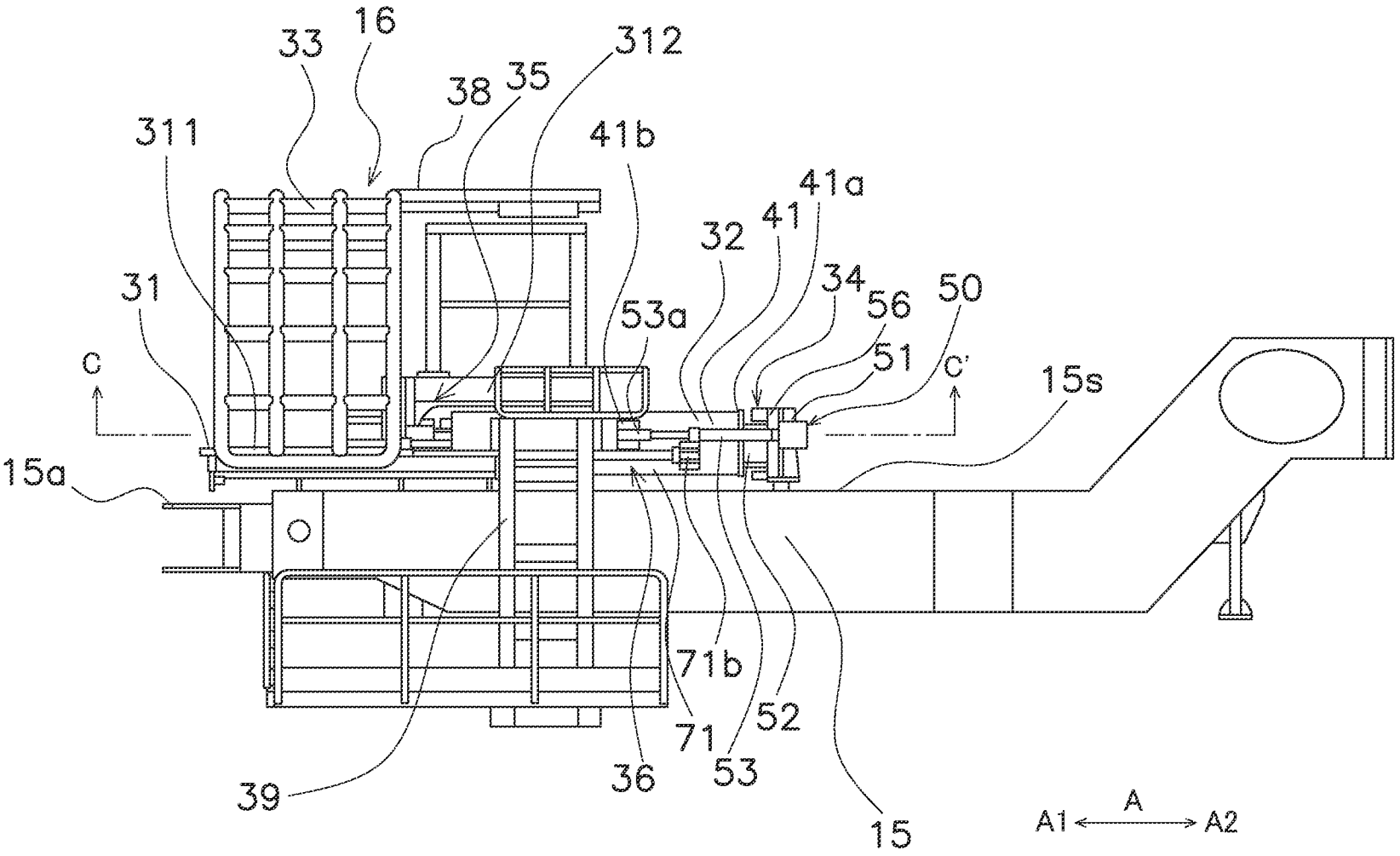
FIG. 4 is a side view illustrating the workbench and a frame in FIG. 1.
Figure 5:
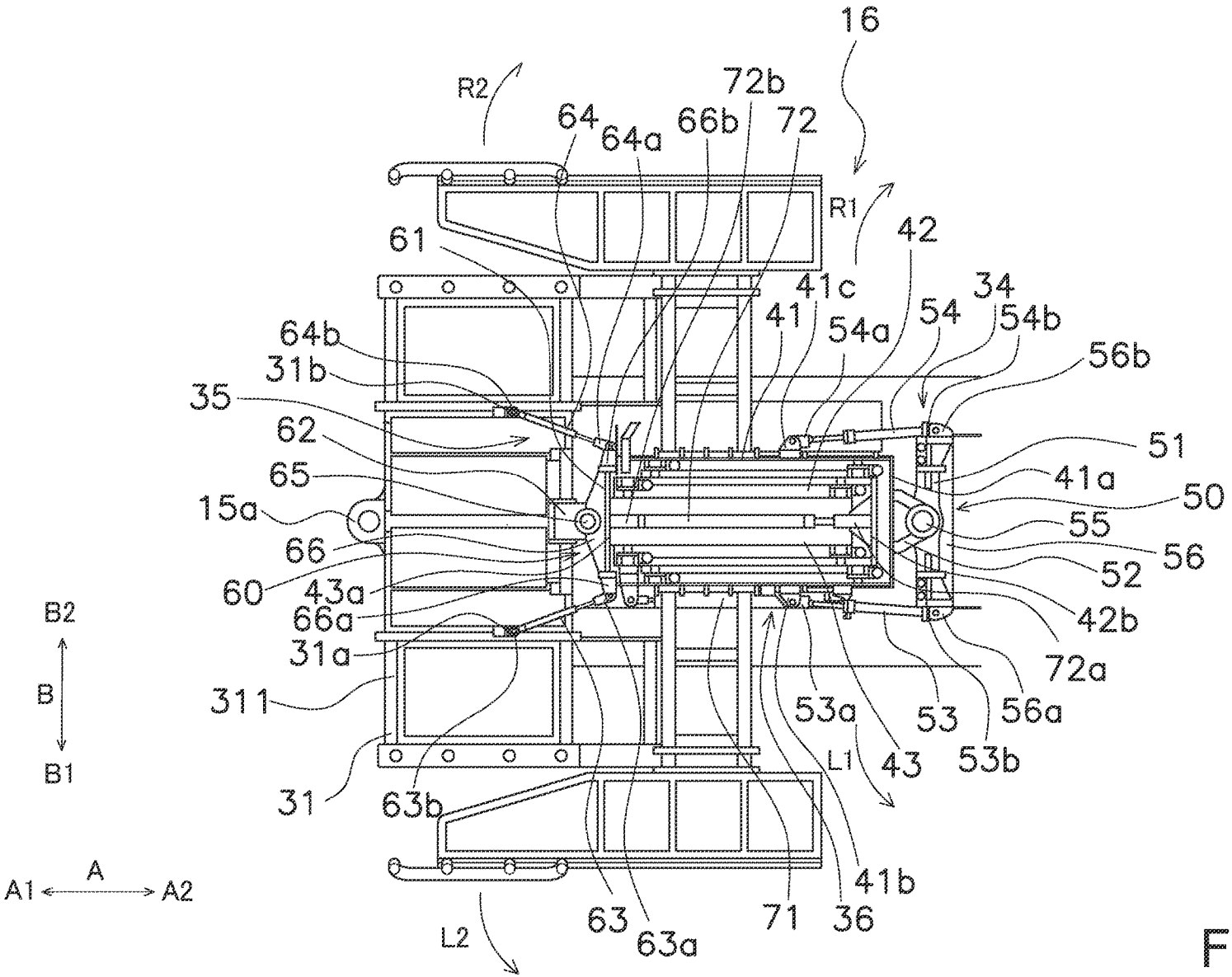
FIG. 5 is a cross-sectional view between arrows C and C' in FIG. 4.

FIG. 4 is a side view illustrating the workbench 16 and the frame 15. FIG. 5 is a cross-sectional view between arrows C and C' in FIG. 4.

The workbench 16 includes a work deck 31, a boom 32, a roof 33, a boom rotating mechanism 34, a work deck rotating mechanism 35, and an extension/contraction section 36.

(Work Deck 31)

The work deck 31 is supported above the frame 15 by a boom 32. The work deck 31 has a plate shape and is disposed substantially parallel to the upper surface 15*s* of the frame 15.

The work deck 31 includes a deck front section 311 and a deck rear section 312. The deck front section 311 is disposed on the front side of the boom 32. The deck front section 311 is rotatably connected to the boom 32 via a second connecting section 60, as shown in FIG. 5. The deck front section 311 has a substantially rectangular shape when viewed from above, and is disposed so that its long sides extend along the width direction B. The width of the deck front section 311 protrudes in the left-right direction more than the width of the frame 15. The closer the left end and right end of the deck front section 311 are to the side wall of the tunnel, the easier it is for the operator to perform the work of attaching the wire mesh. In the deck front section 311, the work of attaching the wire mesh is performed.

The deck rear section 312 is disposed behind the deck front section 311 and is connected to the deck front section 311. The deck rear section 312 is disposed above the boom 32 as shown in FIG. 4. A ladder 39 is disposed on the deck rear section 312 for the operator to ascend and descend.

(Boom 32)

The boom 32 is connected to the frame 15 and the work deck 31. The boom 32 is disposed above the frame 15 and substantially parallel to the upper surface 15*s* of the frame 15, as shown in FIG. 4. The boom 32 is attached to the frame 15 via a first connecting section 50. The boom 32 extends forward from the position of attaching to the frame 15.

Figure 6:
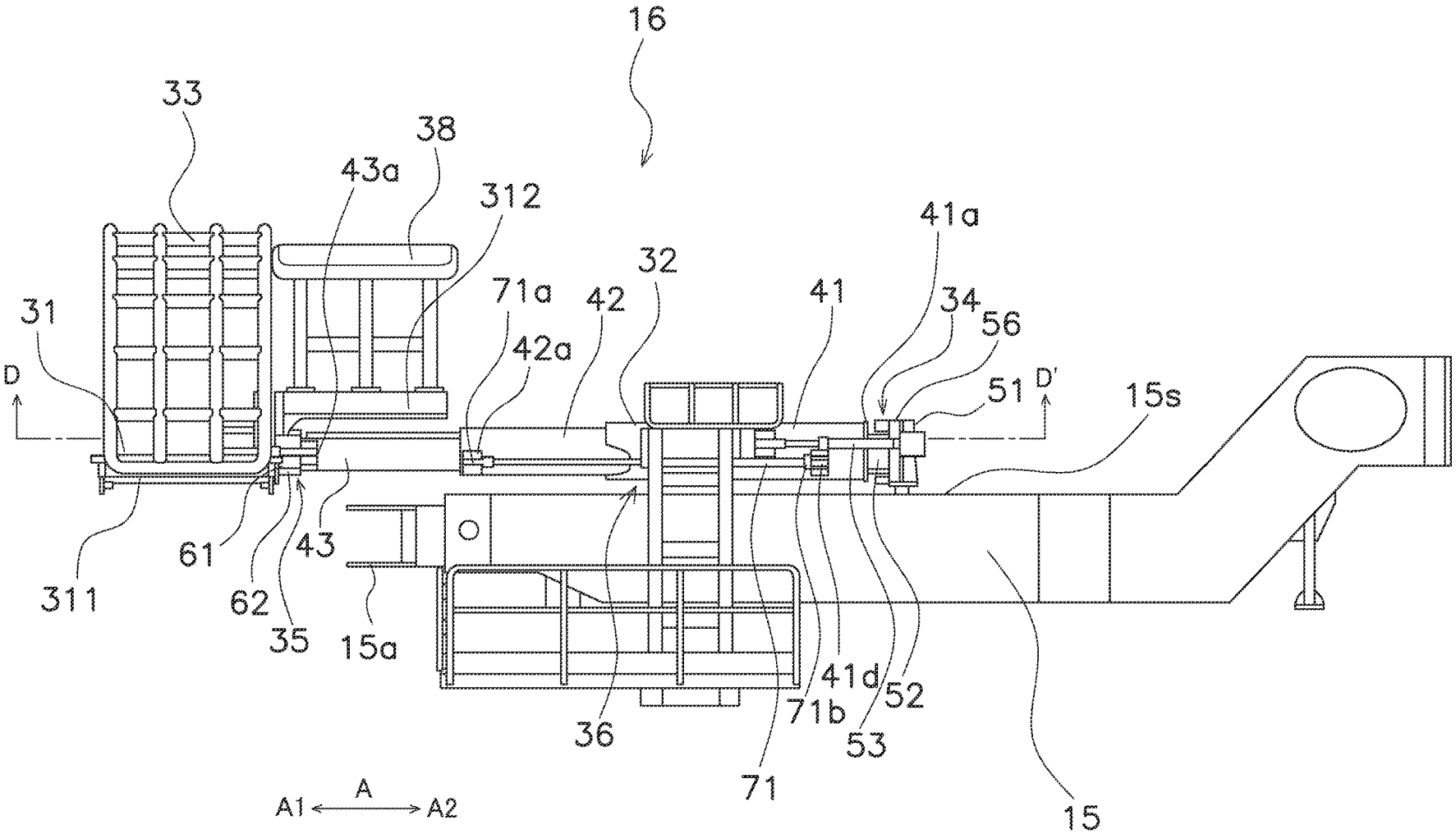
FIG. 6 is a side view illustrating a state in which an arm in FIG. 4 is extended.
Figure 7:
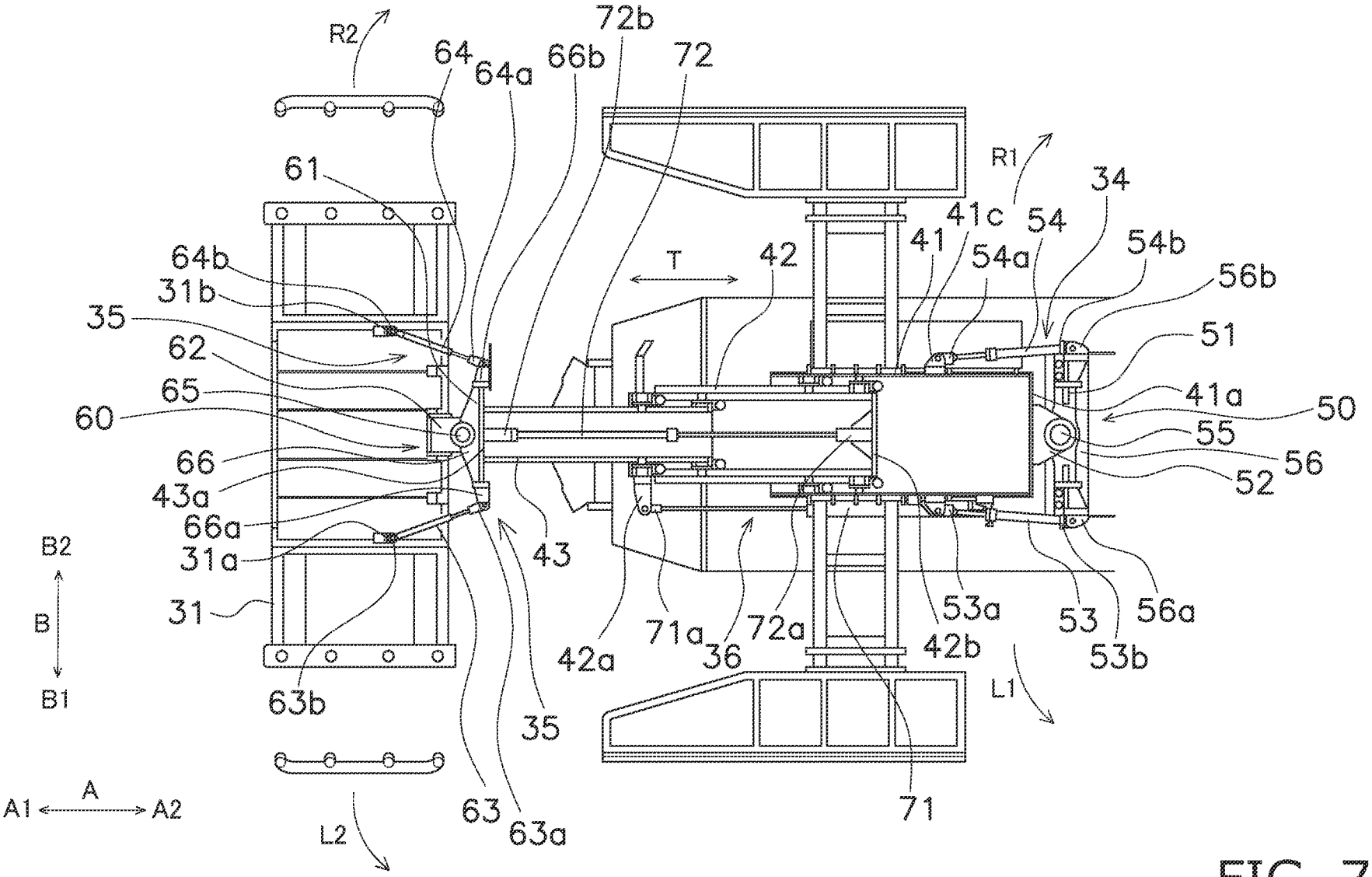
FIG. 7 is a cross-sectional view between arrows D and D' in FIG. 6.

The boom 32 has a telescopic structure and is configured to be extendable and contractable. FIG. 6 is a side view of the workbench 16 and the frame 15 illustrating a state in which the boom 32 is extended. FIG. 7 is a cross-sectional view between arrows D and D' in FIG. 6.

The boom 32 includes a first boom member 41, a second boom member 42, and a third boom member 43, as shown in FIGS. 5 to 7. The first boom member 41 has a box shape with an open front surface, and a rear end surface 41*a* (an example of a first end) of the first boom member 41 is provided with a boom side connecting section 52, which will be described later, as shown in FIG. 5.

The second boom member 42 is disposed inside the first boom member 41 in the width direction B, as shown in FIGS. 5 and 7. The second boom member 42 has a box shape with an open front surface. The second boom member 42 is provided so as to be slidable in the front-rear direction with respect to the first boom member 41.

The third boom member 43 is disposed inside in the width direction B of the second boom member 42. The third boom member 43 has a box shape with an open rear surface. The third boom member 43 is provided so as to be slidable in the front-rear direction with respect to the second boom member 42. The front end surface 43*a* (an example of a second end) of the third boom member 43 is provided with a boom side connecting section 61, which will be described later.

The configuration that allows the second boom member 42 to slide relative to the first boom member 41 is not particularly limited, and the configuration that allows the third boom member 43 to slide relative to the second boom member 42 is not particularly limited, and for example, a linear guide or the like can be used. Taking the configuration of the second boom member 42 and the first boom member 41 as an example, as linear guides, rails are disposed inside the side surface of the first boom member 41 and blocks are disposed outside the side surface of the second boom member 42 and the block is fitted to the rail. The configurations of the second boom member 42 and the third boom member 43 are the same.

By providing the first boom member 41, the second boom member 42, and the third boom member 43 in this manner, the boom 32 can be extended and contracted. The boom 32 is extended and contracted by the extension/contraction section 36, which will be described later.

(Roof 33)

The roof 33 is disposed above the deck front section 311 as shown in FIG. 3. The roof 33 is convexly curved upward along the width direction B. The roof 33 has a lattice shape, and the operator can work though a space of the lattice shape. On the upper surface of the roof 33, a wire mesh is spread to be attached to the walls of the tunnel. The roof 33 is also provided to protect workers from falling rocks. A roof 38 is also provided above the deck rear section 312.

(Boom Rotating Mechanism 34)

As shown in FIG. 5, the boom rotating mechanism 34 includes a first connecting section 50 (an example of a first connecting section) and a pair of swing cylinders 53 and 54 (an example of a first actuator). The first connecting section 50 connects the boom 32 and the frame 15. The first connecting section 50 includes a frame side connecting section 51 and a boom side connecting section 52. The frame side connecting section 51 rotatably connects the boom 32 to the frame 15. The frame side connecting section 51 includes a shaft member 55 and a connecting member 56.

Referring to FIG. 5, the shaft member 55 has a columnar shape and is disposed above the upper surface 15*s* of the frame 15 in the vertical direction. The shaft member 55 is fixed to the frame side connecting section 51. The connecting member 56 is fixed to the frame side connecting section 51. The connecting member 56 is a member extending from the shaft member 55 toward both sides in the width direction B, as shown in FIGS. 5 and 7.

The boom side connecting section 52 is provided on the rear end surface 41*a* of the first boom member 41. The boom side connecting section 52 is provided with, for example, a vertical hole, and the shaft member 55 is inserted into this hole. With this configuration, the boom 32 can rotate about the shaft member 55 with respect to the frame 15.

A pair of swing cylinders 53 and 54 are attached between the boom 32 and the connecting member 56. Hydraulic cylinders, for example, can be used for the swing cylinders 53 and 54. One swing cylinder 53 includes a rod-side end 53*a* rotatably attached to an attachment section 41*b* provided on the left side surface of the first boom member 41. A cylinder-side end 53*b* of the swing cylinder 53 is rotatably attached to a left end 56*a* of the connecting member 56.

The other swing cylinder 54 includes a rod-side end 54*a* rotatably attached to an attachment section 41*c* provided on the right side surface of the first boom member 41. A cylinder-side end 54*b* of the swing cylinder 54 is rotatably attached to a right end 56*b* of the connecting member 56.

With the above configuration, the boom 32 can be rotated with respect to the frame 15 by extending and contracting the swing cylinders 53 and 54. For example, by contracting the swing cylinder 53 and extending the swing cylinder 54, the boom 32 can be rotated to the left (L1 direction), and the work deck 31 attached to the tip of the boom 32 can be rotated to the left. Also, by contracting the swing cylinder 54 and extending the swing cylinder 53, the boom 32 can be rotated to the right (R1 direction), and the work deck 31 can be rotated to the right. In this manner, the work deck 31 can be rotated left and right with the length of the boom 32 as the rotation radius.

(Work Deck Rotating Mechanism 35)

The work deck rotating mechanism 35 includes a second connecting section 60 and a pair of rotation cylinders 63 and 64 (an example of a second actuator).

The second connecting section 60 connects the boom 32 and the work deck 31. The second connecting section 60 includes a boom side connecting section 61 and a deck side connecting section 62.

The boom side connecting section 61 includes a shaft member 65 and a connecting member 66. The connecting member 66 is fixed to the front side of the front end surface 43*a* of the third boom member 43. The connecting member 66 is formed to extend on the both sides in the width direction B more than the third boom member 43. The shaft member 65 has a columnar shape and is disposed along the vertical direction at the center of the connecting member 66 in the width direction B.

The deck side connecting section 62 is fixed to the rear end of the deck front section 311, as shown in FIG. 7. The deck side connecting section 62 is disposed below the deck rear section 312.

The deck side connecting section 62 is provided with, for example, a hole along the vertical direction, and the shaft member 65 is inserted into this hole. With this configuration, the work deck 31 can rotate with respect to the boom 32 about the shaft member 65.

A pair of rotation cylinders 63 and 64 are attached between the connecting member 66 and the work deck 31. Hydraulic cylinders, for example, can be used for the rotation cylinders 63 and 64. A rod side end 63*a* of one rotation cylinder 63 is rotatably attached to a left end 66*a* of the connecting member 66.

A cylinder side end 63*b* of the rotation cylinder 63 is rotatably attached to an attachment section 31*a* of the deck front section 311. The attachment section 31*a* is provided on the left side of the center of the deck front section 311 in the width direction B.

A rod side end 64*a* of the other rotation cylinder 64 is rotatably attached to a right end 66*b* of the connecting member 66. A cylinder side end 64*b* of the rotation cylinder 64 is rotatably attached to an attachment section 31*b* of the deck front section 311. The attachment section 31*b* is provided on the right side of the center of the deck front section 311 in the width direction B.

With such a configuration, the work deck 31 can be rotated with respect to the boom 32 by extending and constructing the rotation cylinders 63 and 64. For example, by contracting the rotation cylinder 63 and extending the rotation cylinder 64, the work deck 31 can be rotated to the left (L2 direction). By contracting the rotation cylinder 64 and extending the rotation cylinder 63, the work deck 31 can be rotated to the right (R2 direction).

In this manner, the work deck 31 can rotate with respect to the boom 32 with a rotation radius around the shaft member 65.

(Extension/Contraction Section 36)

As shown in FIG. 7, the extension/contraction section 36 (an example of the moving section) includes a first slide cylinder 71 (an example of a third actuator) and a second slide cylinder 72 (an example of the third actuator).

The first slide cylinder 71 extends and contracts the first boom member 41 and the second boom member 42. The second slide cylinder 72 extends and contracts the second boom member 42 and the third boom member 43. Hydraulic cylinders, for example, can be used for the first slide cylinder 71 and the second slide cylinder 72.

The first slide cylinder 71 is disposed on the left side of the boom 32 in the width direction B. The rod side end 71*a* of the first slide cylinder 71 is connected to an attachment section 42*a* provided near the tip of the left side surface of the second boom member 42, as shown in FIGS. 6 and 7. A cylinder side end 71*b* of the first slide cylinder 71 is connected to an attachment section 41*d* provided near the rear end of the left side surface of the first boom member 41.

Accordingly, when the first slide cylinder 71 is extended, the second boom member 42 moves forward with respect to the first boom member 41, and the first boom member 41 and the second boom member 42 are extended. Further, when the first slide cylinder 71 is contracted, the second boom member 42 moves rearward with respect to the first boom member 41, and the first boom member 41 and the second boom member 42 are contracted.

The second slide cylinder 72 is disposed inside the second boom member 42 and the third boom member 43, as shown in FIG. 7. A rod side end 72*a* of the second slide cylinder 72 is attached to the rear end surface 42*b* of the second boom member 42.

A cylinder side end 72*b* of the second slide cylinder 72 is attached to the front end surface 43*a* of the third boom member 43.

Accordingly, when the second slide cylinder 72 is extended, the third boom member 43 moves forward with respect to the second boom member 42, and the second boom member 42 and the third boom member 43 are extended. Further, when the second slide cylinder 72 is contracted, the third boom member 43 moves rearward with respect to the second boom member 42, and the second boom member 42 and the third boom member 43 are contracted.

As described above, by extending the first slide cylinder 71 and extending the second slide cylinder 72, as shown in FIGS. 6 and 7, the first boom member 41, the second boom member 42 and the third boom member 43 are extended so that the boom 32 is extended and the work deck 31 can be moved forward A1 (see arrow T in FIG. 7).

By contracting the first slide cylinder 71 and contracting the second slide cylinder 72, as shown in FIGS. 4 and 5, the first boom member 41, the second boom member 42 and the third boom member 43 are contracted so that the boom 32 is contracted and the work deck 31 can be moved rearward A2 (see arrow T in FIG. 7).

The shaft member 65, which is the rotation shaft of the work deck 31 with respect to the boom 32, moves as the boom 32 extends and contracts, and the range of the movement is set so as to include the main beam, the frame 15 and the connecting sections 14*a* and 15*a* in the front-rear direction A. That is, when the boom 32 is most extended, the shaft member 65 is positioned forward of the connecting sections 14*a* and 15*a*, and when the boom 32 is most contracted, the shaft member 65 is positioned behind the connecting sections 14*a* and 15*a*.

<Operation>

As described above, the boom 32 that supports the work deck 31 is rotatable left and right with respect to the frame 15 about the shaft member 55. The work deck 31 is rotatable left and right about a shaft member 65 disposed at the tip of the boom 32. Furthermore, since the boom 32 is extendable and contractable, the work deck 31 is movable along the longitudinal direction of the boom 32.

Figure 8:
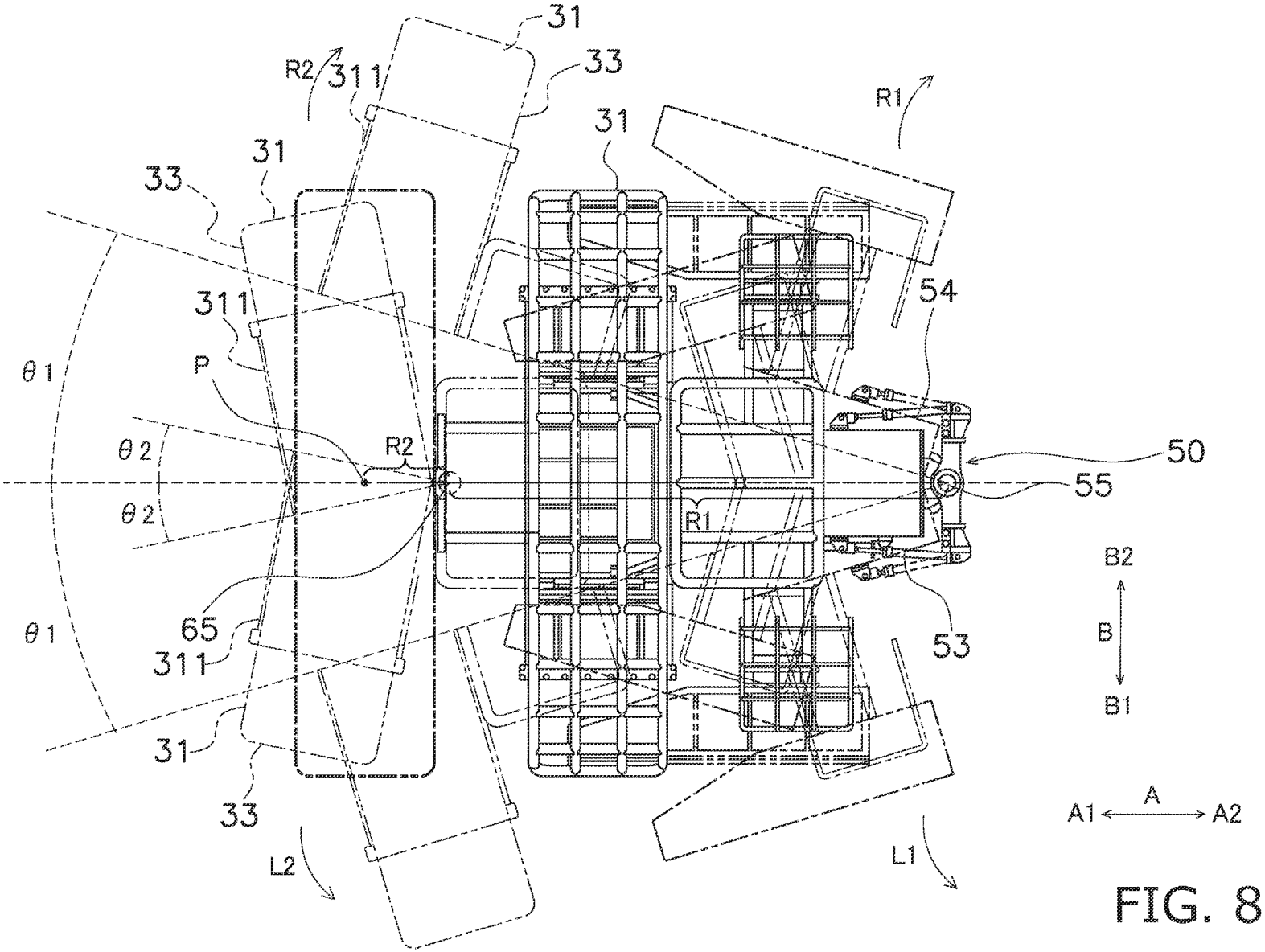
FIG. 8 is a view illustrating rotation of a work deck and a boom of the workbench in FIG. 1.

FIG. 8 is a view illustrating an example of movement of the work deck 31. FIG. 8 shows a state in which the boom 32 is extended from the state of the work deck 31 indicated by solid lines. In the work deck 31 in the state where the boom 32 is extended, the contours of the deck front section 311 and the roof 33 are indicated by two-dot chain lines. The rotation angle range of the work deck 31 with respect to the boom 32 is indicated by 82, and the rotation angle range of the boom 32 with respect to the frame 15 is indicated by 81. For example, assuming that the position of the work deck 31 is the center position P of the deck front section 311 where the worker works, the center position P of the deck front section 311 is rotatable with a rotation radius R2 from the shaft member 65 to the center position P. Further, the deck front section 311 can also rotate together with the boom 32 with the rotation radius R1 from the shaft member 55 to the center position P. It should be noted that the rotation radius R1 is variable according to the extension and contraction of the boom 32.

As described above, the workbench 16 of the present embodiment is configured that the work deck 31 is rotatable with respect to the boom 32 and is rotatable together with the boom 32, and is movable along the boom 32.

Therefore, even when constructing a tunnel with a sharp curve, the work deck 31 can be laid along the curve, which facilitates the lining work.

A tunnel excavation device 1 of the present embodiment includes a main body 10, a frame 15, and a workbench 16. The main body 10 includes a front body section 11 and a rear body section 12. The front body section 11 includes a cutter head 21 provided with a plurality of disk cutters 83 (an example of cutters). The rear body section 12 includes a gripper section 90 for obtaining a reaction force during excavation, and is disposed behind the front body section 11. The frame 15 is disposed behind the main body 10 so as to be connected to the main body 10. The workbench 16 is disposed above the frame 15 so as to be rotatable with respect to the frame 15.

Since the workbench 16 is rotatable with respect to the frame 15 in this manner, the workbench 16 can be disposed along the wall of the tunnel when constructing the tunnel with a sharp curve. Therefore, the gap between the tunnel wall and the workbench 16 can be narrowed, so that the lining work can be easily performed even when constructing a sharply curved tunnel. The lining work includes the work of attaching a wire mesh to the tunnel wall between the supports.

In the tunnel excavation device 1 of the present embodiment, the workbench 16 includes a work deck 31 and a boom 32. A boom 32 supports the work deck 31 on the frame 15.

Thus, the work deck 31 can be supported above the frame 15 by the boom 32.

In the tunnel excavation device 1 of the present embodiment, the boom 32 is rotatably supported by the frame 15. A work deck 31 is supported by the boom 32.

Thereby, the work deck 31 and the frame 15 can be connected by the boom 32.

In the tunnel excavation device 1 of the present embodiment, the work deck 31 is rotatably supported by the boom 32.

Thereby, the work deck 31 can be rotated with respect to the boom 32, and the work deck 31 can be easily aligned with the wall of the tunnel.

The tunnel excavation device 1 of the present embodiment includes swing cylinders 53 and 54 (an example of a first actuator). The swing cylinders 53 and 54 rotate the boom 32 with respect to the frame 15.

Thereby, the boom 32 can be rotated with respect to the frame 15 by driving the swing cylinders 53 and 54.

The tunnel excavation device 1 of the present embodiment includes rotation cylinders 63 and 64 (an example of a second actuator). Rotation cylinders 63 and 64 rotate the work deck 31 with respect to boom 32.

Thereby, the work deck 31 can be rotated with respect to the boom 32 by driving the rotation cylinders 63 and 64.

In the tunnel excavation device 1 of the present embodiment, the work deck 31 is rotatable with respect to the frame 15 with at least two different radii of rotation.

Since the radius of rotation can be changed in this way, it is possible to dispose the workbench 16 along the wall of the tunnel according to the curvature of the tunnel, which facilitates the lining work.

In the tunnel excavation device 1 of the present embodiment, the boom 32 includes a rear end surface 41*a* (an example of a first end) and a front end surface 43*a* (an example of a second end). The rear end surface 41*a* of the boom 32 is rotatably supported by the frame 15 via a first connecting section 50. The work deck 31 is rotatably supported by a front end surface 43*a* of the boom 32 via a second connecting section 60. The work deck 31 is rotatable with a first rotation radius R1 together with the boom 32 around a shaft member 55 (an example of a first rotation shaft) provided on the first connecting section 50. The work deck 31 is rotatable with a second rotation radius R2 around a shaft member 65 (an example of a second rotation shaft) provided in the second connecting section 60.

Thereby, the work deck 31 can be rotated with two different rotation radii, and the attitude of the work deck 31 can be easily matched with the curvature of the tunnel.

In the tunnel excavation device 1 of the present embodiment, the workbench 16 includes an extension/contraction section 36 (an example of a moving section) capable of moving the work deck 31 in the front-rear direction.

Thereby, the position of the work deck 31 in the front-rear direction of the tunnel can be adjusted. For example, the front-rear position of the work deck 31 can be adjusted between the supports.

In the tunnel excavation device 1 of the present embodiment, the extension/contraction section 36 includes a first slide cylinder 71 and a second slide cylinder 72 (an example of a third actuator) for extending and contracting the boom 32 in the longitudinal direction.

In this manner, the front-rear position of the work deck can be adjusted by extending and contracting the boom.

An embodiment of the present disclosure has been described above, but the present disclosure is not limited to the above embodiment, and various modifications are possible without departing from the gist of the invention.

While in the above-described embodiment, as an example of the moving mechanism, the extension/contraction section 36 including the first slide cylinder 71 and the second slide cylinder 72 is used, but it is not limited to this, and for example, a configuration such as a motor and a ball screw may be used as long as the boom 32 can be extended and contracted.

While in the above embodiment, the boom 32 includes three members (the first boom member 41, the second boom member 42, and the third boom member 43), but the number of members is not limited to three.

While in the above embodiment, the swing cylinders 53 and 54 are used in the boom rotating mechanism 34, but the present invention is not limited to this, and the boom rotating mechanism may be composed of gears or the like, as long as the boom 32 can be rotated with respect to the frame 15.

While in the above embodiment, the rotation cylinders 63 and 64 are used in the work deck rotating mechanism 35, but the present invention is not limited to this, and the work deck rotating mechanism may be composed of gears or the like, as long as the work deck 31 can be rotated with respect to the boom 32.

While in the above embodiment, the work deck 31 includes the deck front section 311 and the deck rear section 312, the deck rear section 312 may not be provided.

The tunnel excavation device of the present disclosure has the effect of enabling construction of tunnels with a smaller radius of curvature than conventional ones, and thus can be applied to a wider range of tunnel construction.

What is claimed is:

1. A tunnel excavation device comprising:

a main body including a front body section including a cutter head provided with a plurality of cutters and a rear body section including a gripper section for obtaining a reaction force during excavation, the rear body section being disposed behind the front body section;

a frame disposed behind the main body, the frame being connected to the main body; and a workbench disposed above the frame so as to be rotatable with respect to the frame, the workbench including a work deck, and a boom supporting the work deck on the frame, the work deck being rotatable with respect to the frame with at least two different rotation radii.

2. The tunnel excavation device according to claim 1, wherein the boom is rotatably supported by the frame, and the work deck is supported on the boom.

3. The tunnel excavation device according to claim 2, further comprising a first actuator configured to rotate the boom with respect to the frame.

4. The tunnel excavation device according to claim 2, wherein the work deck is rotatably supported on the boom.

5. The tunnel excavation device according to claim 4, further comprising a second actuator configured to rotate the work deck with respect to the boom.

6. The tunnel excavation device according to claim 5, wherein the workbench includes a moving section configured to move the work deck in a front-rear direction.

7. The tunnel excavation device according to claim 6, wherein the moving section includes a third actuator configured to extend and contract the boom in a longitudinal direction.

8. The tunnel excavation device according to claim 2, wherein the workbench includes a moving section configured to move the work deck in a front-rear direction.

9. The tunnel excavation device according to claim 8, wherein the moving section includes a third actuator configured to extend and contract the boom in a longitudinal direction.

10. The tunnel excavation device according to claim 1, wherein the work deck is rotatably supported on the boom.

11. The tunnel excavation device according to claim 10, further comprising a second actuator configured to rotate the work deck with respect to the boom.

12. The tunnel excavation device according to claim 1, wherein the boom includes a first end and a second end, the first end of the boom is rotatably supported by the frame via a first connecting section, the work deck is rotatably supported by the second end of the boom via a second connecting section, the work deck is rotatable about a first rotation shaft provided at the first connecting section together with the boom at a first rotation radius, and the work deck is rotatable about a second rotation shaft provided at the second connecting section at a second rotation radius.

13. The tunnel excavation device according to claim 1, wherein the workbench includes a moving section configured to move the work deck in a front-rear direction.

14. The tunnel excavation device according to claim 13, wherein the moving section includes a third actuator configured to extend and contract the boom in a longitudinal direction.

15. The tunnel excavation device according to claim 1, wherein the boom is supported on the platform so as to be rotatable about a first rotation axis, and the work deck is supported on the boom so as to be rotatable around a second rotation axis, the second rotation axis being disposed forward of the first rotation axis.

16. The tunnel excavation device according to claim 1, wherein the tunnel excavation device is arranged to perform lining work along a tunnel wall formed by the tunnel excavation device.

17. The tunnel excavation device according to claim 1, wherein the main body further includes a main beam that is rotatably connected to the forward body portion and supports the rear body portion so that the rear body portion can slide forward and backward, the frame being rotatably attached to the rear end of the main beam.

* * * * *